US011161151B1

(12) United States Patent
Scott

(10) Patent No.: US 11,161,151 B1
(45) Date of Patent: Nov. 2, 2021

(54) SCREEN ASSEMBLY FOR VIBRATORY SEPARATION

(71) Applicant: National Oilwell Varco, L.P., Houston, TX (US)

(72) Inventor: Eric Landon Scott, Conroe, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 16/856,945

(22) Filed: Apr. 23, 2020

(51) Int. Cl.
*B07B 1/46* (2006.01)

(52) U.S. Cl.
CPC ..... *B07B 1/4663* (2013.01); *B07B 1/469* (2013.01); *B07B 1/4618* (2013.01); *B07B 1/4672* (2013.01)

(58) Field of Classification Search
CPC ... B07B 1/4663; B07B 1/4618; B07B 1/4672; B07B 1/469; B01L 3/5027
See application file for complete search history.

(56) References Cited

U.S. PATENT DOCUMENTS

| | | | | |
|---|---|---|---|---|
| 8,601 | A * | 12/1851 | Wheeler | B07B 1/469 209/357 |
| 6,629,610 | B1 * | 10/2003 | Adams | B07B 1/4618 |
| 10,166,574 | B2 * | 1/2019 | Mitchell | B07B 1/4618 |
| 10,556,196 | B2 * | 2/2020 | Larson | B01D 33/0361 |
| 2009/0301943 | A1 * | 12/2009 | Bigelow | B07B 1/4618 209/399 |
| 2011/0094950 | A1 * | 4/2011 | Dahl | B07B 1/4672 210/85 |

OTHER PUBLICATIONS

PCT/US2012/027128 International Search Report and Written Opinion of the International Searching Authority, dated May 4, 2021, 8 pages.

* cited by examiner

*Primary Examiner* — Charles A Fox
*Assistant Examiner* — Jessica L Burkman
(74) *Attorney, Agent, or Firm* — Nolte Lackenbach Siegel

(57) ABSTRACT

A screen assembly for vibratory separation includes a screen having a plurality of raised screen components formed therein, with each of the raised screen components defining a face oriented to oppose a flow direction of the screen assembly. In examples, a screen of the screen assembly is assembled from a plurality of metal cloth layers bonded together. Bonding of the metal cloth layers may be accomplished by a sintering process.

15 Claims, 6 Drawing Sheets

SCREEN ASSEMBLY FOR VIBRATORY SEPARATION

BACKGROUND

One type of vibratory separation device that is often used to separate materials during well drilling operations, such as oil and gas well drilling operations and the like, is known as a "shale shaker". On many drilling rigs, a shale shaker may be used to treat drilling fluid mixtures returning from the wellbore to remove undesirable solids materials, such as drill cuttings, from the fluid, i.e., drilling mud, that is used to drill the well.

In general, a shale shaker includes a box-like frame, called a basket, which receives the material to be separated, e.g., a mixture of drill cuttings and drilling mud or fluid. A deck, or other screen-holding or screen-mounting structure, is supported within the basket and includes one or more screen panel assemblies that remove solid particles from fluid as the fluid passes through the screens of the screen panel assemblies. A vibrating apparatus is coupled to the shale shaker to vibrate the screen panel assemblies to enhance the separation process. A plurality of screen panel assemblies may be arranged in a cascading sequence over which the fluid passes.

In operation, the mixture of drill cuttings and drilling fluid is fed into the shale shaker on top of the screen panel assemblies. Particles that are larger than the openings in the screen panel assemblies are caught on top of the screens, while the fluid passes through the screens and is captured in containers or drains situated below the screen sections. The shale shaker is configured to vibrate the screen panel assemblies in such a manner that the particles caught by the screens are moved along, and eventually off of, the screen panel assemblies. Therefore, the screen panel assemblies must be configured to process a high volume of fluid, separate particles of various different sizes from the fluid, and withstand the high forces that are generated by the vibration of the shale shaker and movement of the drill cuttings and drilling fluid.

SUMMARY

In an embodiment of the present disclosure, a screen assembly for vibratory separation may include: a screen comprising a plurality of wire cloth layers, each of the wire cloth layers having a plurality of raised screen components; a perforated plate disposed beneath the screen; and a support frame coupled to the screen and the perforated plate. The plurality of wire cloth layers may be bonded together to form the screen. The plurality of wire cloth layers may be bonded together by a sintering process. The plurality of wire cloth layers may include stainless steel wire cloth. The plurality of raised screen components may each define a rear face oriented to oppose a flow direction of the screen assembly. The plurality of raised screen components may each define a top face and a rear face, the top face sloping downward in the flow direction from a rear face to a bottom surface plane of the screen and being oriented to oppose a vibratory direction of the screen to a greater extent than the bottom surface plane. The at least one of the wire cloth layers may differ in flexibility from at least another of the wire cloth layers. Each of the wire cloth layers may be selected from the group fine mesh, medium mesh, or coarse mesh.

In a further embodiment of the present disclosure, a screen for vibratory separation may include a plurality of wire cloth layers, each of the wire cloth layers having a plurality of three-dimensional (3D) raised screen components formed therein, wherein the plurality of wire cloth layers are diffusion bonded together to form the screen. Each of the raised screen components may comprise at least one rear surface substantially perpendicular to a bottom surface plane of the screen to oppose a flow direction of the screen assembly. The plurality of wire cloth layers may be bonded by a sintering process. The plurality of 3D raised screen components may each define a top face sloping downward in the flow direction from the rear face to a bottom surface plane of the screen and being oriented to oppose a vibratory direction of the screen to a greater extent than the bottom surface plane, wherein the top face is oriented substantially perpendicular to a vibratory direction of the screen. The plurality of 3D raised screen components may define a serpentine flow of fluids and solids over the screen. The plurality of raised screen components may be formed by stamping each of the plurality of wire cloth layers between stamping dies in a stamping press.

In a still further embodiment of the present disclosure, a method of assembling a screen for vibratory separation may include: forming a plurality of raised screen components in a plurality of wire cloth layers; arranging the plurality of wire cloth layers in a stack; and bonding the stack of wire cloth layers to form the screen. The bonding of the stack of wire cloth layers may include a sintering process. The forming of the plurality of raised screen components in the plurality of wire cloth layers may include stamping each of the plurality of wire cloth layers between stamping dies in a stamping press. The plurality of raised screen components may each define a face opposing a flow direction of the sheet structure. The plurality of raised screen components may each define a top face sloping downward in the flow direction from the rear race to a bottom surface plane of the screen and being oriented to oppose a vibratory direction of the screen to a greater extent than the bottom surface plane. The arranging of the plurality of wire cloth layers in the stack may further comprise aligning the plurality of raised screen components in the plurality of wire cloth layers.

These and other embodiments of the present disclosure are more fully described herein with reference to the accompanying figures.

BRIEF DESCRIPTION OF THE DRAWINGS

The present disclosure is best understood from the following detailed description when read with the accompanying figures, wherein.

It is emphasized that, in accordance with the standard practice in the industry, various features are not drawn to scale. In fact, the dimensions of the various features may be arbitrarily increased or reduced for clarity of discussion or illustration.

DETAILED DESCRIPTION

Illustrative examples of the subject matter claimed below are disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

As used herein, the terms "diffusion bonding" and "sintering" refer to a processes that utilize, time, temperature, pressure, and/or atmosphere to realign and permanently bond the molecular elements of one or more materials, such as where they may intersect or touch each other. A sintering process may be utilized, for example, to molecularly bond two or more layers of metallic (e.g., wire) cloth into a unitary sheet.

Figure 1:
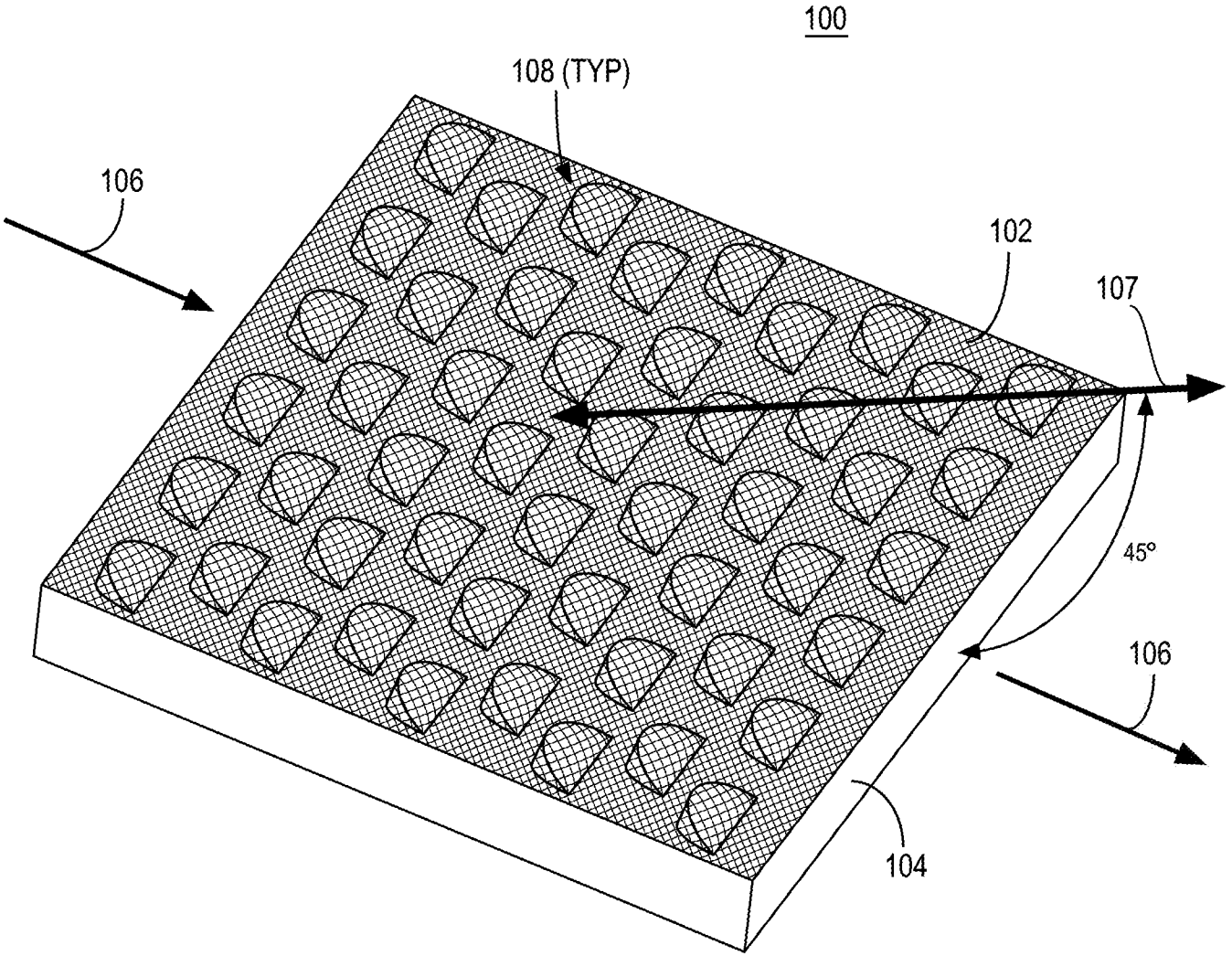
FIG. 1 is an isometric view of a screen panel assembly for vibratory separation in accordance with one or more examples.

FIG. 1 is an isometric view of a screen panel assembly 100 in accordance with one or more examples. As shown in FIG. 1, screen panel assembly 100 includes a screen 102 carried by a support frame 104. In some examples, support frame may be made of steel or a composite material and has a generally rectangular configuration. Screen panel assembly is adapted to be vibrated in a direction indicated by arrow 107 in FIG. 1, which may be approximately 45° from a substantially planar bottom surface 120 of screen 102.

Figure 2:
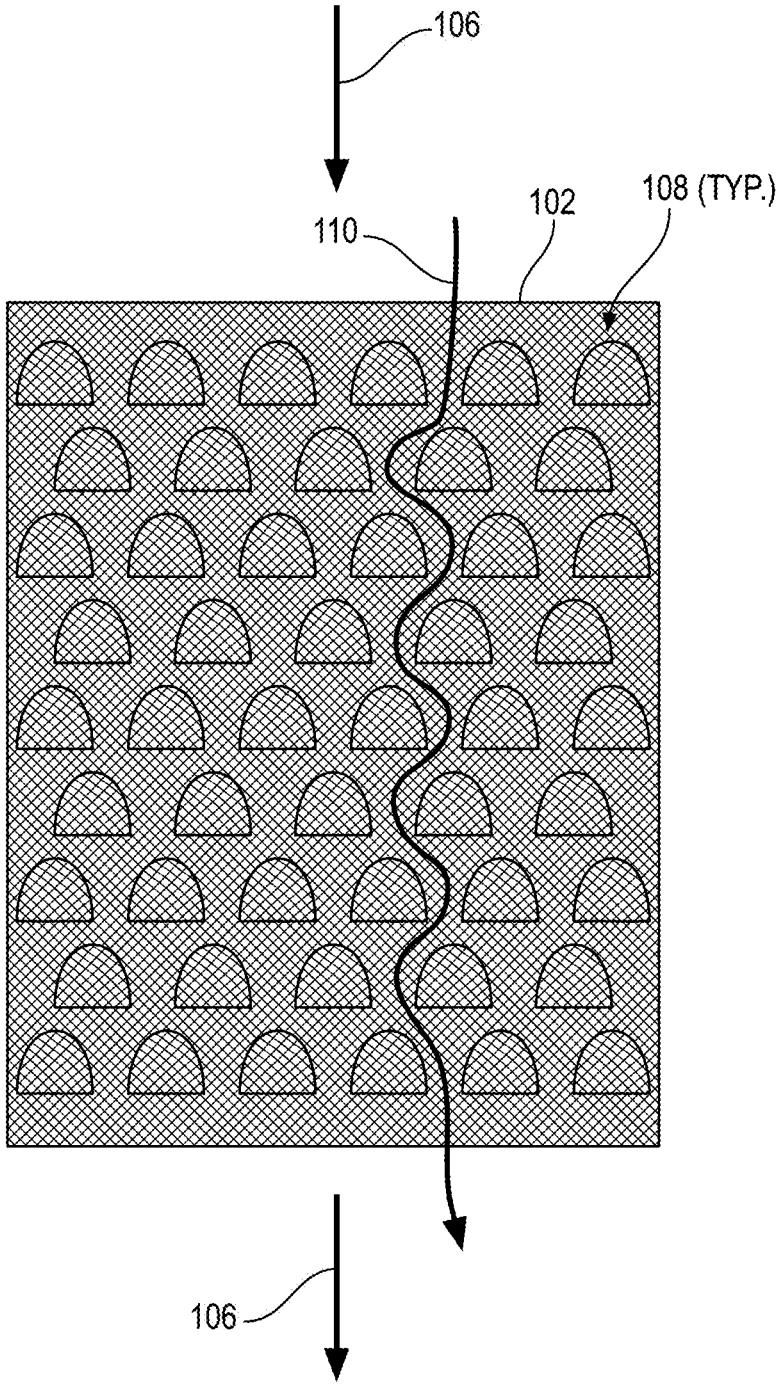
FIG. 2 is a top, plan view of the screen panel assembly of FIG. 1.

In the example of FIG. 1, screen 102 has a plurality of three-dimensional raised screen components 108 formed therein, as hereinafter described. FIG. 2 is a top view of screen 102 showing an example arrangement of raised screen components 108 formed therein. (As used herein, the designation "TYP" will be used in conjunction with certain reference numerals to denote repeating features in the Figures, in the interest of clarity.) Each raised screen component 108 may define a rear face 116 opposing flow direction 106 and a top face 118 oriented to oppose vibratory direction 107 to a greater extent than planar bottom surface 120.

Examples of screen panels having three-dimensional raised screen components defined thereon are disclosed in U.S. Pat. Nos. 10,166,574 and 10,556,196 to Larson et al., each entitled "Vector Maximizing Screen" and each commonly assigned to the assignee of the present application. The Larson et al. '574 and '196 patents are each incorporated by reference herein in their respective entireties.

As disclosed in the Larson et al. '574 and '196 patents, raised screen components such as raised screen components 108 in the present examples define a first plane (such as rear face 116 of raised screen components 108) oriented at a first angle relative to the screen panel and a wedge surface (such as top face 118 of raised screen components) positioned at a back side of the raised screen components. The inclined screen surface has a front edge that is aligned with the planar surface 120 of the screen 106, this top face 118) being substantially perpendicular to the vibratory direction 107 of the screen.

In this example, the staggered arrangement of raised screen components 108 is such that the flow path of material passing over the top surface of screen 102 tends to be diverted side-to-side in a serpentine manner, as indicated by example path 110 in FIG. 2. This serpentine flow path increases the surface area over which the material passes as it flows in the overall flow direction (indicated by arrows 106) of screen panel assembly 100.

Figure 3:
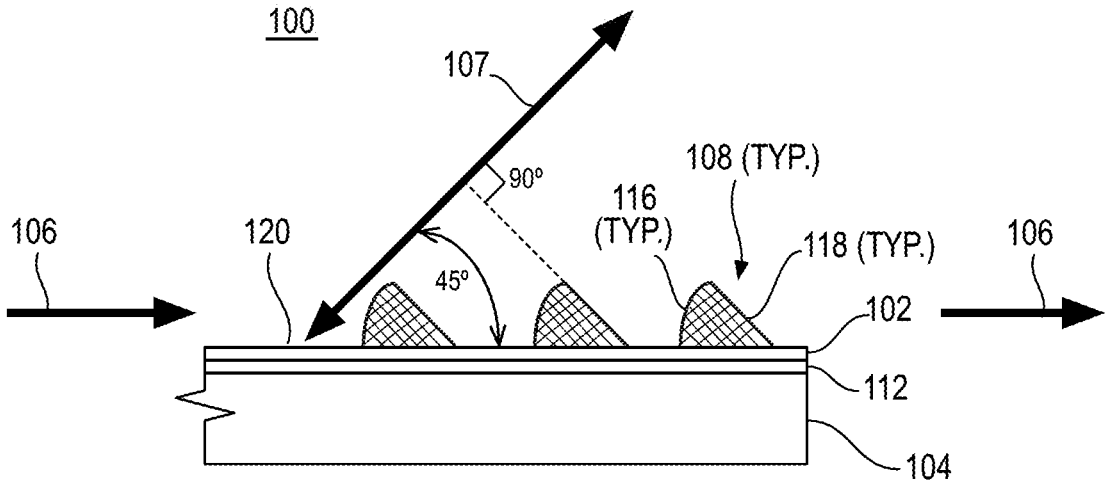
FIG. 3 is a side, plan view of a portion of the screen panel assembly of FIG. 1.
Figure 4:
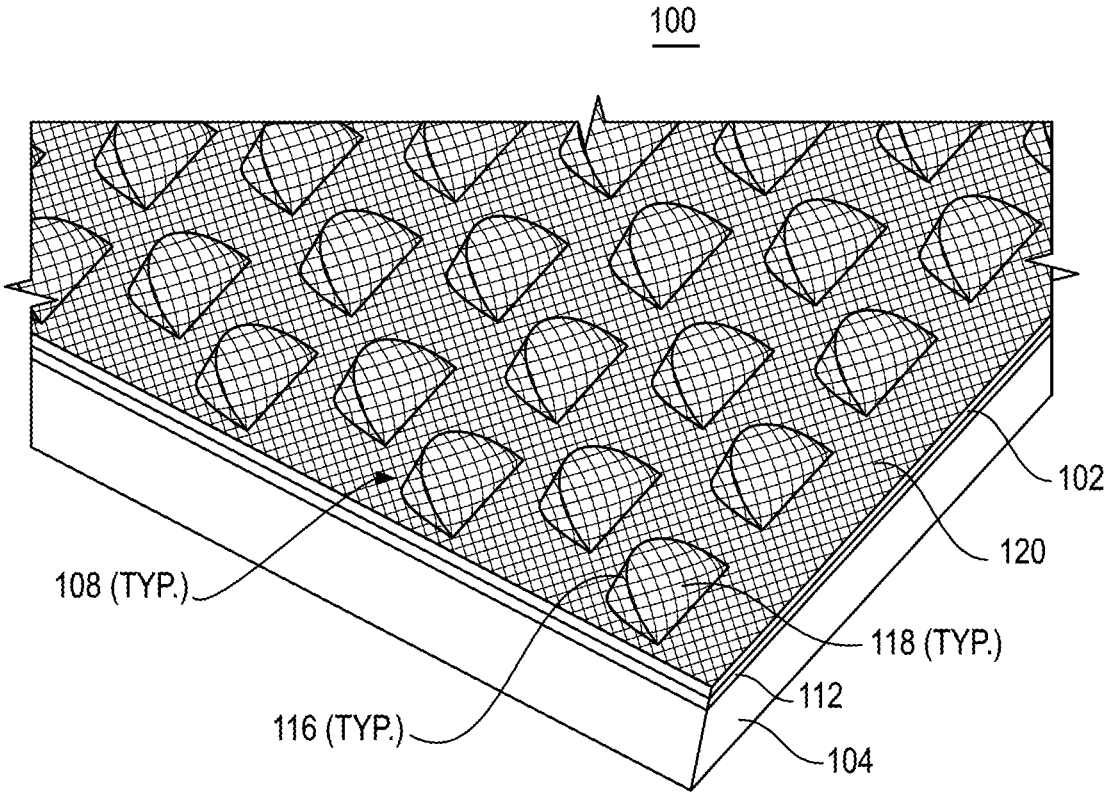
FIG. 4 is an isometric view of a portion of the screen panel assembly of FIG. 1.

FIG. 3 is a side view of a portion of screen panel assembly 100, and FIG. 4 is an isometric view of a portion of screen panel assembly 100. As shown in FIGS. 3 and 4, screen assembly may include a perforated plate 112 supporting screen 102 and carried by support frame 104. As noted, vibratory direction 107 may be oriented at approximately a 45° angle with respect to bottom surface 120 of screen 102, when screen assembly 100 is installed within a vibratory separator. In various examples, the angular orientation of top faces 118 is in greater opposition to vibratory direction 107 than the bottom surface 120 of screen 102.

Figure 5:
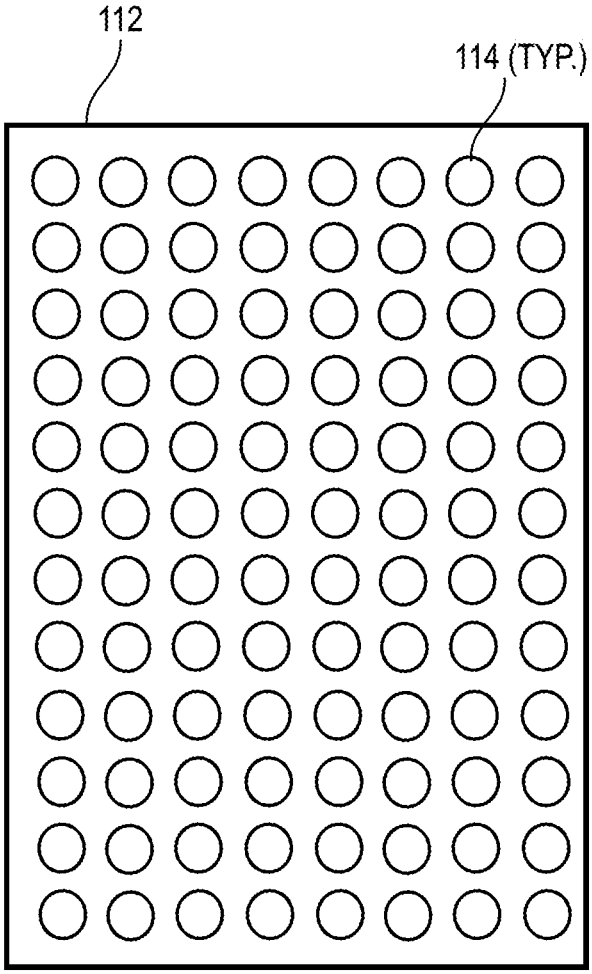
FIG. 5 is a top view of a perforated plate of the screen panel assembly of FIG. 1.

FIG. 5 is a top view of perforated plate 112 according to one example. As shown in FIG. 5, perforated plate 112 may be made of steel, and has a plurality of perforations 114 therein, to allow fluid passage through not only the screen 102 but also the perforated plate 112. Perforated plate 112 may also serve to provide mechanical stability to screen 102, providing support for the weight of material (fluids and solids) passing over screen 102.

It is to be noted that the pattern of raised screen components 108 on screen 102 as well as the pattern of perforations 114 in perforated plate 112 may vary in different examples. The patterns of raised screen components 108 and perforations 114 may, but are not necessarily aligned in various examples. Raised screen components 108 and perforations 114 may be larger or smaller in various examples.

Referring again to FIGS. 3 and 4, each raised screen component 108 may have a face 116 oriented to oppose the flow of material over screen 102 in the flow direction of screen panel assembly 100 indicated by arrows 106 in FIGS. 1 and 2. In the example of FIGS. 1-4, face 116 may curve around the rear and sides of each raised screen component 108. Further, each raised screen component 108 may have a top face 118 sloping and downward forward (relative to a flow direction indicated by the arrows 106) down to the substantially planar bottom surface 120 of screen 102.

Further, each top face 118 of raised screen components 108 may be oriented to oppose the vibratory direction 107 of screen 102 during operation. In some examples, top faces 118 may be oriented substantially perpendicular (i.e., at a 90° angle) to vibratory direction 107, as shown in FIG. 3. The opposing angular orientation of top faces 118, relative to vibratory direction 107, which is greater than the opposing angular orientation of bottom surface 120 to vibratory direction 107, may enhance the fluid flow through screen 102.

Figure 6:
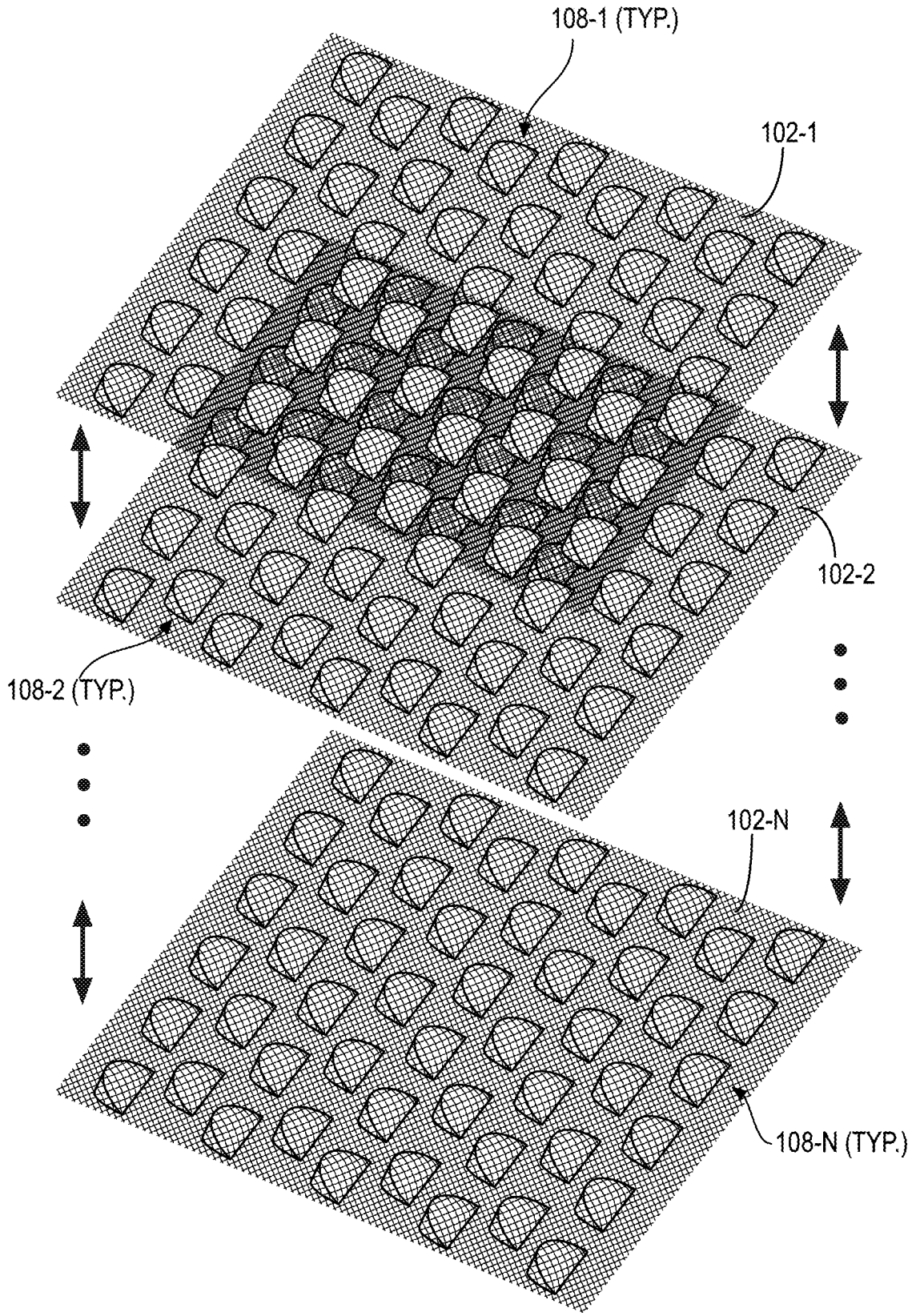
FIG. 6 is an exploded view of the screen of the screen panel assembly of FIG. 1.

FIG. 6 depicts a method of assembly of a screen for vibratory separation and shows an exploded, isometric view of screen 102 according to one or more examples. As shown in FIG. 6, screen 102 may comprise a plurality of layers

102-1, 102-2, . . . 102-N of metal cloth, each of which having raised screen components 108 formed therein as herein described. As shown in FIG. 6, each layer 102-1 . . . 102-N has a pattern of raised screen components 108-1 . . . 108-N, respectively, formed therein, and the layers 102-1 . . . 102-N are arranged in a stack. Note that stacking the layers 102-1 to 102-N includes aligning the raised screen components 108 in each of the layers. Layers 102-1 . . . 102-N may then combined to form a screen. In some examples, the joining of layers 102-1 . . . 102-N may be accomplished by diffusion bonding, such as by a sintering process.

In some examples, some or all of the layers 102-1 . . . 102-N of screen 102 may have have different mesh coarseness, e.g., fine, medium, and coarse, and may consequently have different degrees of flexibility and strength. The overall strength of the resulting screen will derive from the collective strength of the individual layers 102-1 . . . 102-N after the layers are sintered together.

Figure 7A:
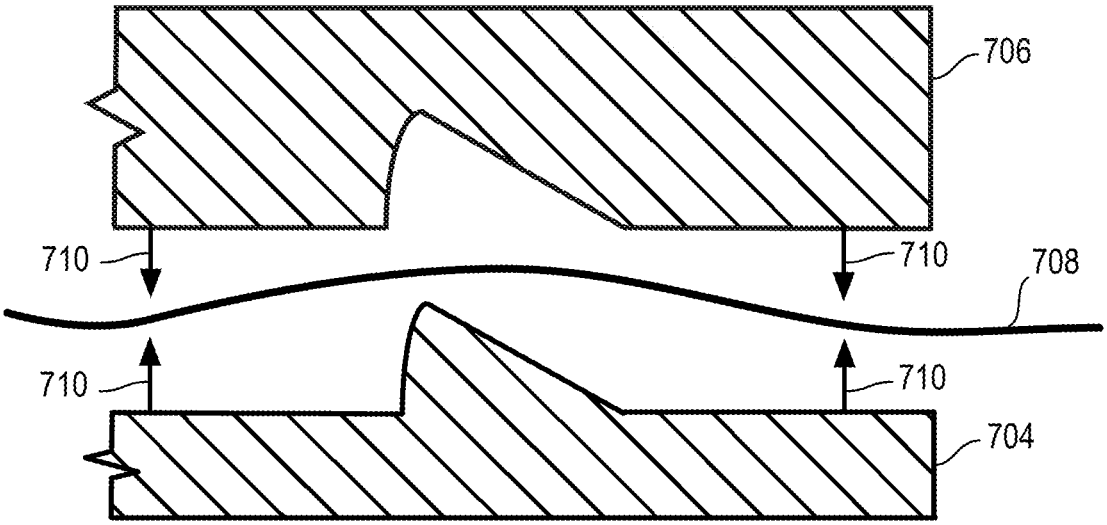
FIGS. 7A and 7B are sectioned side views of a stamping process for forming raised screen components in a screen for vibratory separation.
Figure 7B:
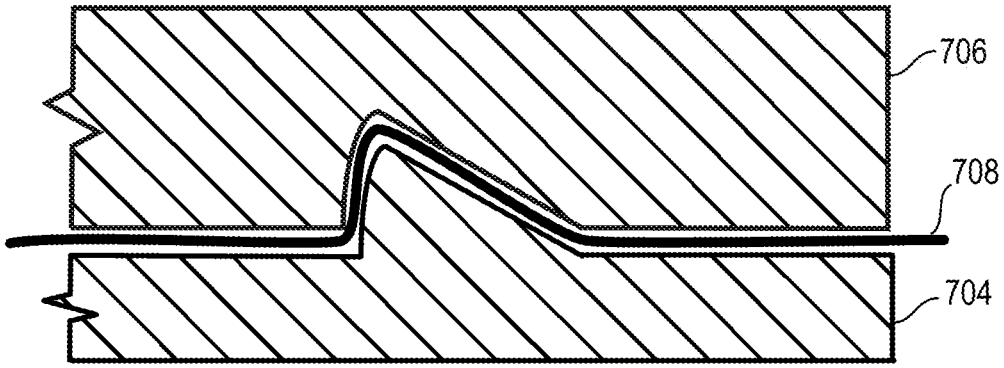

FIGS. 7A and 7B illustrate an example of forming raised screen components in a metal cloth 702, such as raised screen components 108-1 . . . 108-N in metal cloths 102-1 . . . 102-N from the example of FIG. 6. As shown in FIGS. 7A and 7B, a forming process may utilize stamping press, such as a hydraulic press, with a mating pair of stamping dies 704 (male) and 706 (female). A sheet of metal cloth 702 may be positioned between stamping dies 704 and 706, and a stamping press may force the dies 704 and 706 together, as indicated by arrows 710. The shape defined by stamping dies 704 and 706 is then imparted to metal cloth 702. While only a single die pair 704/706 is shown in the example of FIGS. 7A and 7B, in various examples a pattern of raised screen components such as described in connection with the example of FIGS. 1-4, may be formed in each metal cloth 702. As previously described, such a pattern may define a serpentine flow path of material over the surface of the screen formed from a plurality of sheets such as sheet 702.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A screen assembly for vibratory separation, comprising:

a screen comprising a plurality of wire cloth layers, the screen defining a width and a length, each of the wire cloth layers having a plurality of raised screen components, the plurality of raised screen components being spaced apart from one another along both the width and the length, the plurality of wire cloth layers being sintered together, the plurality of raised screen components being arranged in a staggered configuration to define a serpentine flow of fluids and solids over the screen and through the raised screen components, the plurality of raised screen components each defining a rear face oriented to oppose a flow direction of the screen assembly, the plurality of raised screen components each defining a top face sloping downward from the rear face to a bottom surface plane of the screen and being oriented to oppose a vibratory direction of the screen to a greater extent than the bottom surface plane, an interface of the rear face and the top face being curved, the plurality of wire cloth layers being formed from a mesh material, the rear face directing the serpentine flow of fluids around a curve defined by the interface.

2. The screen assembly of claim 1, wherein the plurality of wire cloth layers comprise stainless steel wire cloth.

3. The screen assembly of claim 1, wherein at least one of the wire cloth layers differs in flexibility from at least another of the wire cloth layers.

4. The screen assembly of claim 3, wherein each of the wire cloth layers is selected from the group fine mesh, medium mesh, or coarse mesh.

5. The screen assembly of claim 1, further comprising:

a perforated plate disposed beneath the screen.

6. The screen assembly of claim 5, further comprising:

a support frame coupled to the screen and the perforated plate.

7. A screen for vibratory separation, comprising:

a plurality of wire cloth layers, each of the plurality of wire cloth layers defining a width and a length, each of the wire cloth layers having a plurality of three-dimensional (3D) raised screen components formed therein, the plurality of three-dimensional (3D) components being spaced apart from one another along both the width and the length and being arranged in a staggered configuration to define a serpentine flow of fluid and solids over the screen and through the raised screen components, each of the three-dimensional (3D) components defining a top face and a rear face, the top face being generally planar and angled with respect to a bottom surface plane of the screen, the rear face and an interface of the rear face and the top face being curved, the rear face facilitating the serpentine flow of fluid and solids over the screen, wherein the plurality of wire cloth layers are diffusion bonded and sintered together to form the screen.

8. The screen of claim 7, wherein each raised screen component comprises at least one rear surface substantially perpendicular to a bottom surface plane of the screen to oppose a flow direction of the screen assembly.

9. The screen of claim 7, wherein the top face slopes downward in the flow direction from the rear face to the bottom surface plane of the screen and is oriented to oppose a vibratory direction of the screen to a greater extent than the bottom surface plane, wherein the top face is oriented substantially perpendicular to a vibratory direction of the screen.

10. The screen of claim 9, wherein the plurality of raised screen components are formed by stamping each of the plurality of wire cloth layers between stamping dies in a stamping press.

11. A method of assembling a screen for vibratory separation, comprising:

forming a plurality of raised screen components in a plurality of wire cloth layers, each of the plurality of raised screen components defining a top face and a rear face, the top face defining a generally planar surface that is angled with respect to a surface of the screen, the rear face and the top face being joined at an interface that is curved, the plurality of raised screen components being arranged in a staggered configuration and an arrangement in which the plurality of raised screen components are spaced apart from one another along both a width and a length of the screen to define a serpentine path through which fluids and solids are flowable over the screen and through the raised screen components, the rear face facilitating flowing the fluids and solids along the serpentine path;

arranging the plurality of wire cloth layers in a stack; and bonding the stack of wire cloth layers to form the screen, wherein the bonding of the stack of wire cloth layers includes sintering the stack of wire cloth layers together.

12. The method of claim 11, wherein the forming of a plurality of raised screen components in the plurality of wire cloth layers comprises stamping each of the plurality of wire cloth layers between stamping dies in a stamping press.

13. The method of claim 11, wherein the plurality of raised screen components each define a face opposing a flow direction of the sheet structure.

14. The method of claim 13, wherein the top face of each of the plurality of raised screen components slopes downward in the flow direction from the rear face to a bottom surface plane of the screen and is oriented to oppose a vibratory direction of the screen to a greater extent than the bottom surface plane.

15. The method of claim 11 wherein the arranging the plurality of wire cloth layers in the stack further comprises aligning the plurality of raised screen components in the plurality of wire cloth layers.

* * * * *